US008720309B2

(12) United States Patent
Chen

(10) Patent No.: US 8,720,309 B2
(45) Date of Patent: May 13, 2014

(54) RATCHET WRENCH HAVING EASILY ASSEMBLING STRUCTURE

(76) Inventor: Yi-Fu Chen, Taichung (TW)

( * ) Notice: Subject to any disclaimer, the term of this patent is extended or adjusted under 35 U.S.C. 154(b) by 2 days.

(21) Appl. No.: 13/568,148

(22) Filed: Aug. 7, 2012

(65) Prior Publication Data

US 2012/0297935 A1 Nov. 29, 2012

Related U.S. Application Data

(63) Continuation-in-part of application No. 12/611,118, filed on Nov. 3, 2009, now abandoned.

(51) Int. Cl.
*B25B 13/46* (2006.01)

(52) U.S. Cl.
USPC ..... 81/63.2; 81/60; 81/63; 81/63.1

(58) Field of Classification Search
USPC ..... 81/60–63.2, 177.85
See application file for complete search history.

(56) References Cited

U.S. PATENT DOCUMENTS

| | | | | | |
|---|---|---|---|---|---|
| 3,783,703 | A * | 1/1974 | Trimble et al. | ..... | 74/157 |
| 4,257,507 | A * | 3/1981 | Solomon | ..... | 192/43.1 |
| 4,491,043 | A * | 1/1985 | Dempsey et al. | ..... | 81/58 |
| 4,762,033 | A * | 8/1988 | Chow | ..... | 81/63.2 |
| 4,924,737 | A * | 5/1990 | Gummow | ..... | 81/63.2 |
| 5,305,670 | A * | 4/1994 | Fossella et al. | ..... | 81/63.2 |
| 5,448,931 | A * | 9/1995 | Fossella et al. | ..... | 81/63.2 |
| 5,450,773 | A * | 9/1995 | Darrah et al. | ..... | 81/57.39 |
| 5,495,783 | A * | 3/1996 | Slusar et al. | ..... | 81/63.2 |
| 5,584,220 | A * | 12/1996 | Darrah et al. | ..... | 81/57.29 |
| 5,916,339 | A * | 6/1999 | Dumont | ..... | 81/63.1 |
| 5,960,680 | A * | 10/1999 | Chen et al. | ..... | 81/63.2 |
| 6,044,731 | A * | 4/2000 | Hsieh | ..... | 81/63.2 |
| 6,330,842 | B1 * | 12/2001 | Brun | ..... | 81/57.39 |
| 6,435,062 | B1 * | 8/2002 | McCann | ..... | 81/63 |
| 6,499,380 | B1 * | 12/2002 | Hsiao | ..... | 81/63.2 |
| 6,766,716 | B1 * | 7/2004 | Lee | ..... | 81/60 |
| 6,862,956 | B1 * | 3/2005 | Chen | ..... | 81/63.2 |
| 6,912,935 | B2 * | 7/2005 | Hsien | ..... | 81/63.2 |
| 7,066,055 | B1 * | 6/2006 | Lee | ..... | 81/63 |
| 2009/0151518 | A1 * | 6/2009 | Abunameh | ..... | 81/58.2 |
| 2010/0043604 | A1 * | 2/2010 | Chen | ..... | 81/63.2 |

* cited by examiner

*Primary Examiner* — David B Thomas
*Assistant Examiner* — Danny Hong

(57) ABSTRACT

A ratchet wrench having easily assembling structure includes a body, a D-head, a loose ratchet, a heart-shaped spring, a disc and a ring. The body has a head portion. The head portion has a through hole. A plurality of teeth is uniformly defined on the through hole. The D-head is rotatably disposed in the through hole and has a connecting member and a threaded member. The loose ratchet is disposed on the D-head. The heart-shaped spring has a closed tip. The disc is disposed on the head portion. A shouldered hole is opened on the disc. A ring is disposed onto the shouldered hole. The ring is disposed onto the shouldered hole. Under this arrangement, a user engages a tool bit with the connecting member of the present invention to lock a bolt by repeatedly rotating the body of the present invention clockwise/counterclockwise.

3 Claims, 10 Drawing Sheets

RATCHET WRENCH HAVING EASILY ASSEMBLING STRUCTURE

CROSS-REFERENCE TO RELATED APPLICATION

This application is a Continuation-In-Part Application of U.S. application Ser. No. 12/611,118, filed 3 Nov. 2009, and entitled "RATCHET WRENCH HAVING EASILY ASSEMBLING STRUCTURE", now pending.

BACKGROUND OF THE INVENTION

1. Field of the Invention

The present invention relates to a ratchet wrench, and more particularly to a ratchet wrench having easily assembling structure.

2. Description of Related Art

A conventional ratchet wrench, as shown in FIG. 8, comprises: a main body 10 having a head portion 11 at one end thereof, the head portion 11 having a through bore 12, and there being a plurality of teeth 13 formed in an inner wall surface thereof circumscribing the through bore 12; a D-head 20 rotatably disposed in the through bore 12, the D-head 20 having a plug joint portion 22 formed on a first end, a lateral side of the plug joint portion 22 provided a ball 71 thereon partially protruding outward; a threaded portion 21 with a first end connecting to a second end of the plug joint portion 22; a loose ratchet 30 disposed on a lateral side of the D-head, and the top of the loose ratchet 30 provided a hole thereon; a cardioid spring 40 having opposing first and second ends, the first end defined at least an extension leg 41 therewith retained in the hole 31 of the loose ratchet 30, and the second end formed a closed tip 42 therewith; a rotatable disc 50 having a centrally disposed shouldered hole 52, the center of the bottom of the shouldered hole 52 provided a circular penetrating hole 53' therethrough with a diameter matching the outer diameter of the threaded portion 21, the rotatable disc 50 being disposed on the head portion 11 of the main body 10 with the threaded portion 21 of the D-head 20 extending through the circular penetrating hole 53' and a shift pin 51 defined at the bottom of the rotatable disc 50 locating in the closed tip 42 of the cardioid spring 40; and a ring 60 disposed in the shouldered hole 52 and threadedly engaged with the threaded portion 21 so that the D-head rotatably positioned in the through bore 12 of the main body 10. However, Since the circular penetrating hole 53' with a diameter matches with the threaded portion, the user not only have to aim the circular penetrating hole 53' of the rotatable disc 50 at the threaded portion 21, but also have to aim the shift pin 51 of the rotatable disc 50 at the closed tip 42 of the cardioid spring 40 when the conventional ratchet wrench is assembling. Because the inner diameter of the closed tip of the cardioid spring 40 is very small for only matching to accommodate the shift pin 51, so it is not easy and not convenient for the user to assembly the rotatable disc 50 with the threaded portion 21 and the cardioid spring 40.

Another conventional ratchet wrench, as shown in FIG. 9, comprises: a main body 10 having a head portion 11 at one end thereof, the head portion 11 having a through bore 12, and there being a plurality of teeth 13 formed in an inner wall surface thereof circumscribing the through bore; a D-head 20 rotatably disposed in the through bore 12, the D-head 20 having a plug joint portion 22 formed on a first end, a lateral side of the plug joint portion 22 provided a ball 71 thereon partially protruding outward; a threaded portion 21 with a first end connecting to a second end of the plug joint portion 22; a loose ratchet 30 disposed on a lateral side of the D-head 20, and the top of the loose ratchet 30 provided a hole 31 thereon; a cardioid spring 40 having a first end and a second end defined thereon, the first end of the cardioid spring 40 defined at least an extension leg 41 therewith retained in the hole 31 of the loose ratchet 30, and the second end of the cardioid spring formed a closed tip 42 therewith; a rotatable disc 50 having a centrally disposed shouldered hole 52, the center of the bottom of the shouldered hole 52 provided a long groove 53" therethrough, the rotatable disc 50 being disposed on the head portion 11 of the main body 10 with the threaded portion 21 of the D-head extending through the long groove 53" and a shift pin defined at the bottom of the rotatable disc 50 locating in the internal of the closed tip 42 of the cardioid spring; and a ring 60 disposed in the shouldered hole 52 and threadedly engaged with the threaded portion 21 so that the D-head 20 rotatably positioned in the through bore 12 of the main body 10. However, the structures of some elements were not defined clearly, especially the structure of the long groove 53" was not defined to comply with the enablement requirement.

The present invention has arisen to mitigate and/or obviate the disadvantages of the conventional.

SUMMARY OF THE INVENTION

The main objective of the present invention is to provide a ratchet wrench having easily assembling structure.

To achieve the objective, the ratchet wrench having easily assembling structure in accordance with the present invention comprises a body, a D-head, a loose ratchet, a heart-shaped spring, a disc and a ring, the body having a head portion at one end thereof, the head portion having a through hole opened thereon, a plurality of teeth uniformly defined on an inner wall of the through hole, the D-head rotatably disposed in the through hole, the D-head having a connecting member formed at one end thereof, a ball assembled on a lateral side of the connecting member, the ball partially exposed from the connecting member; a threaded member assembled to another end of the D-head, the loose ratchet disposed on a lateral side of the D-head, the loose ratchet having a pinhole opened at a top end thereof, the heart-shaped spring having at least one extension leg defined at one end thereof, the extension leg inserted into the pinhole of the loose ratchet, the heart-shaped spring having a closed tip defined at another end thereof, the disc disposed on a top of the head portion, a shouldered hole opened at a center of the disc, the shouldered hole having a first aperture and a second aperture opened at the bottom thereof, a shift pin defined at the bottom of the disc, the first aperture communicates with the second aperture, a ring disposed onto the shouldered hole for connecting to the threaded member, the ring disposed onto the shouldered hole of the disc for connecting to the threaded member. Wherein, a push rod is passing though the D-head and is positioned by a screw and a button; the button is disposed onto the shouldered hole and the screw is screwed into the push rod; the screw, the push rod and the button are used to control a lateral movement of the ball relative to the D-head; an elastomer is assembled between the button and the ring, and the elastomer encloses a top end of the push rod.

Under this arrangement, when a user rotates the body in one direction, the D-head rotates with the rotation of the head portion because the loose ratchet is engaged with the teeth of the head portion; in contrast, when the user rotates the body in another direction, the D-head does not rotate with the rotation of the head portion because the loose ratchet is disengaged with the teeth of the head portion step by step by the compression of the heart-shaped spring.

Further benefits and advantages of the present invention will become apparent after a careful reading of the detailed description with appropriate reference to the accompanying drawings.

BRIEF DESCRIPTION OF THE DRAWINGS

FIG. 3-1 is another perspective view of the ratchet wrench having easily assembling structure for showing that the threaded member is passing through the second aperture of the disc;

DETAILED DESCRIPTION OF THE INVENTION

Figure 1:
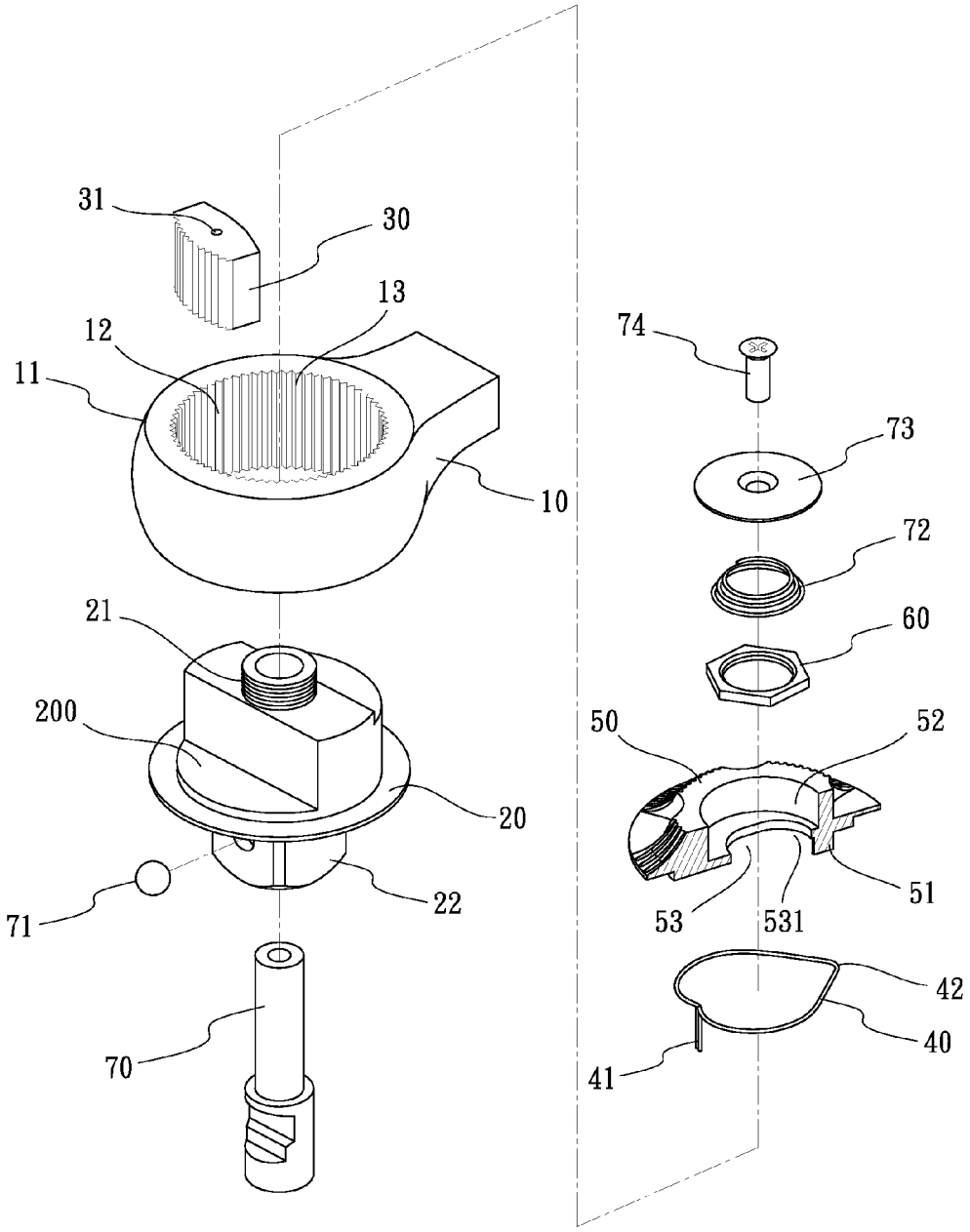
FIG. 1 is an exploded view of a ratchet wrench having easily assembling structure of the present invention.
Figure 2:
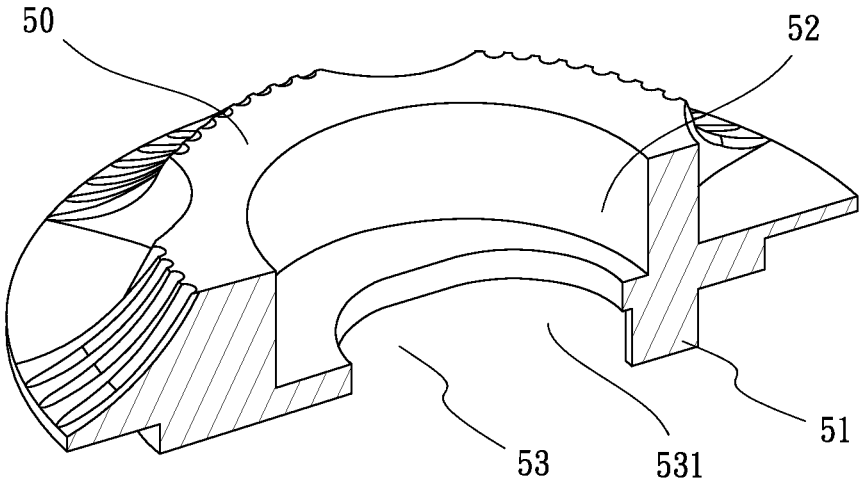
FIG. 2 is a perspective view of a half-cut disc of the present invention.

Referring to FIGS. 1-7, a ratchet wrench having easily assembling structure in accordance with the present invention comprises a body 10, a D-head 20, a threaded member 21, a loose ratchet 30, a substantially heart-shaped spring 40, and a disc 50.

The body 10 has a head portion 11 at one end thereof. The head portion 11 has a through hole 12 opened thereon. A plurality of teeth 13 is uniformly defined on an inner wall of the through hole 12.

The D-head 20 is rotatably disposed in the through hole 12. The D-head 20 has a connecting member 22 formed at one end thereof. A ball 71 is assembled on a lateral side of the connecting member 22. The ball 71 is partially exposed from the connecting member 22.

The threaded member 21 is assembled to another end of the D-head 20 (In the present invention, the threaded member 21 is directly formed with the D-head 20.).

The loose ratchet 30 is disposed on a lateral side of the D-head 20. A cavity 200 is defined at the lateral side of the D-head 20 so that the loose ratchet 30 is disposed onto the cavity 200 of the D-head 20. The lateral side further has a first position and a second position, and the loose ratchet 30 is selectively located at one of the first position and the second position. The loose ratchet 30 has a pinhole 31 opened at a top end thereof (The cavity 200 is not essential in the present invention.).

The spring 40 has at least one extension leg 41 defined at one end thereof. The extension leg 41 is inserted into the pinhole 31 of the loose ratchet 30. The spring 40 has a closed tip 42 defined at another end thereof.

Figure 4:
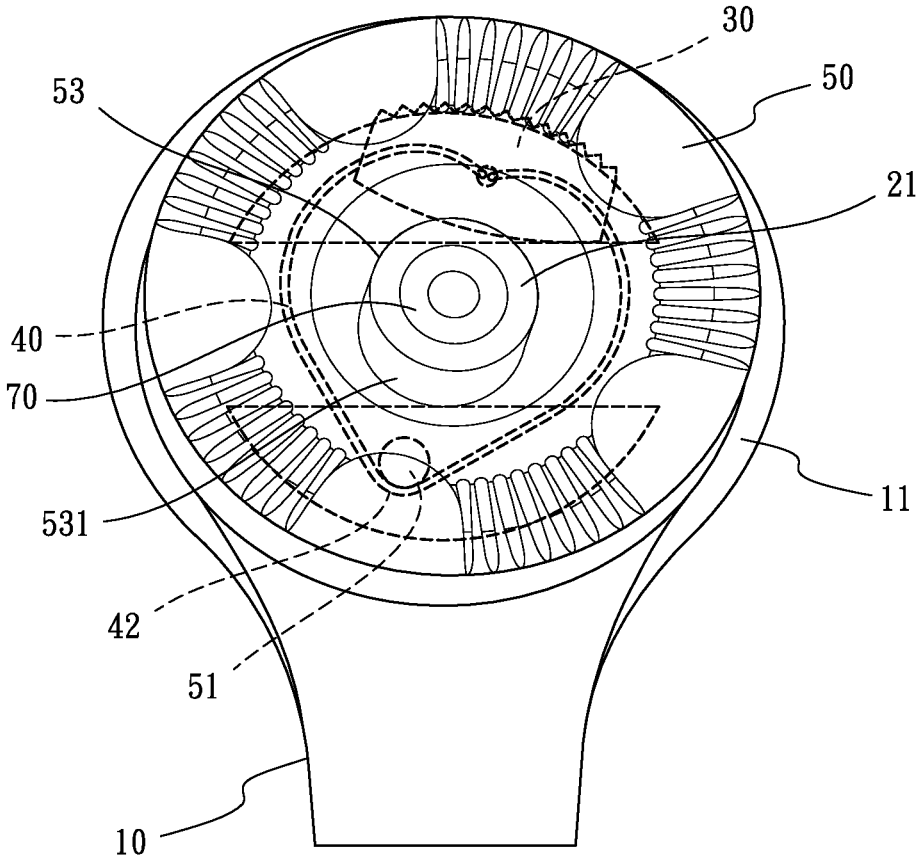
FIG. 4 is a plane view of the present invention for showing a loose ratchet is in a first position and a shift pin is in a first place.
Figure 5:
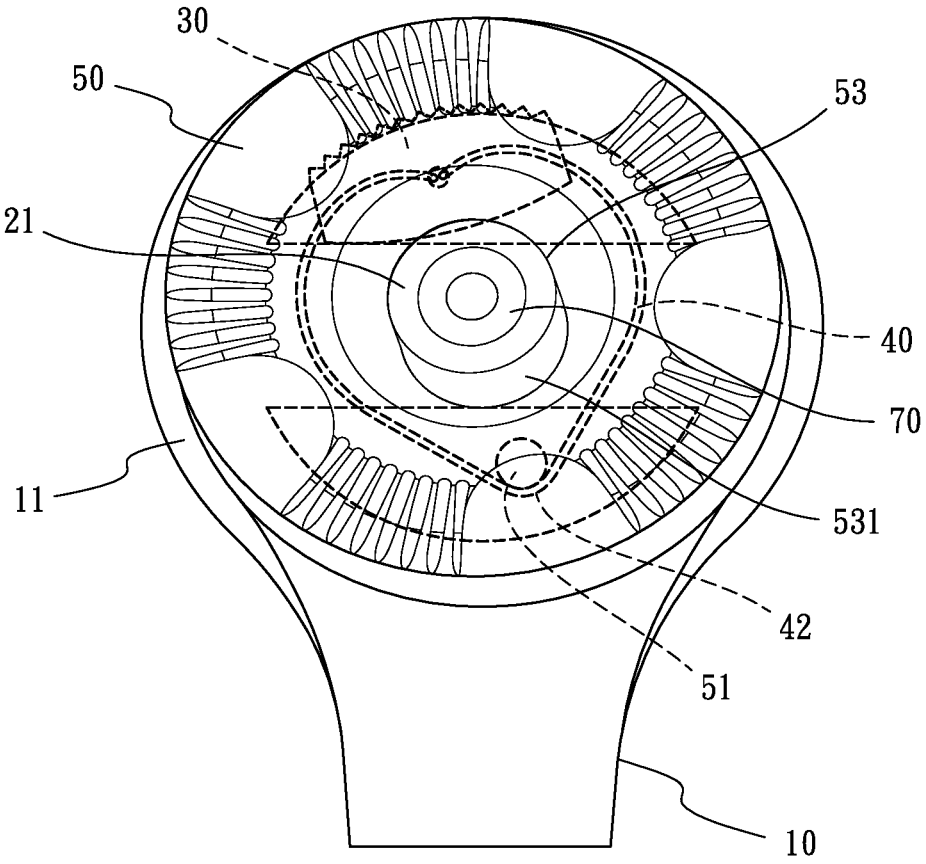
FIG. 5 is a plane view of the present invention for showing the loose ratchet is in a second position and the shift pin is in a second place.

The disc 50 is disposed on a top of the head portion 11. A shouldered hole 52 is opened at a center of the disc 50. The shouldered hole 52 has a first aperture 53 and a second aperture 531 opened at the bottom thereof. A shift pin 51 is defined at the bottom of the disc 50. The shift pin 51 is selectively located at one of a first place and a second place (as shown in FIG. 4-5). The first aperture 53 communicates with the second aperture 531 so that the threaded member 21 is movable between said apertures 53, 531 with respect to the disc 50.

A ring 60 is disposed onto the shouldered hole 52 for connecting to the threaded member 21. In the present invention, the threaded member 21 is screwed into the ring 60 (The method of connecting the threaded member 21 and the ring 60 is not restricted by the present invention.).

The assembling procedures of the present invention are described as following.

Firstly, the D-head 20 is rotatably disposed in the through hole 12 of the body 10; and then the loose ratchet 30 is disposed on the lateral side of the D-head 20 so as to be received in the through hole 12; then, the heart-shaped spring 40 is put on the top of the D-head 20 and the extension leg 41 is inserted in the pinhole 31 of the loose ratchet 30.

Figure 3:
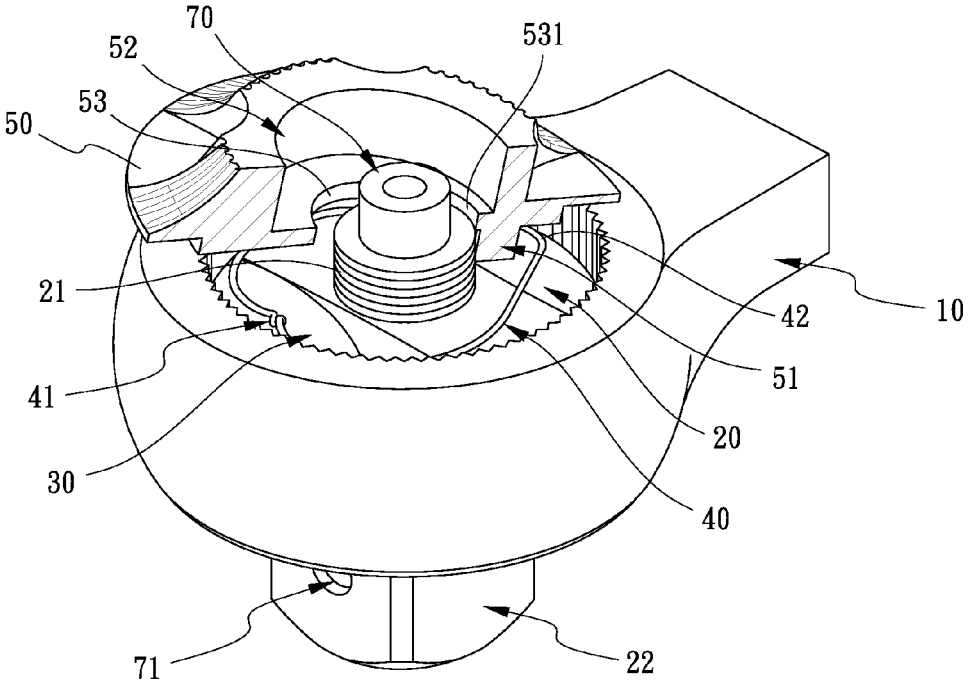
FIG. 3 is a perspective view of the ratchet wrench having easily assembling structure for showing a threaded member is passing through a second aperture of the disc.
Figures 1, 3:
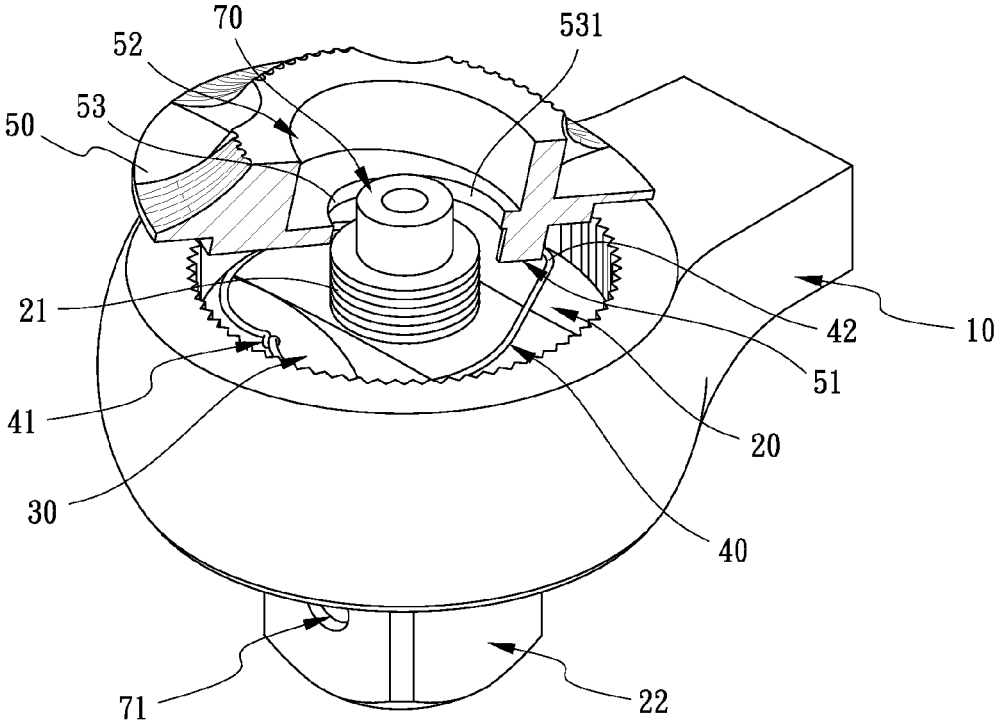
Figure 6:
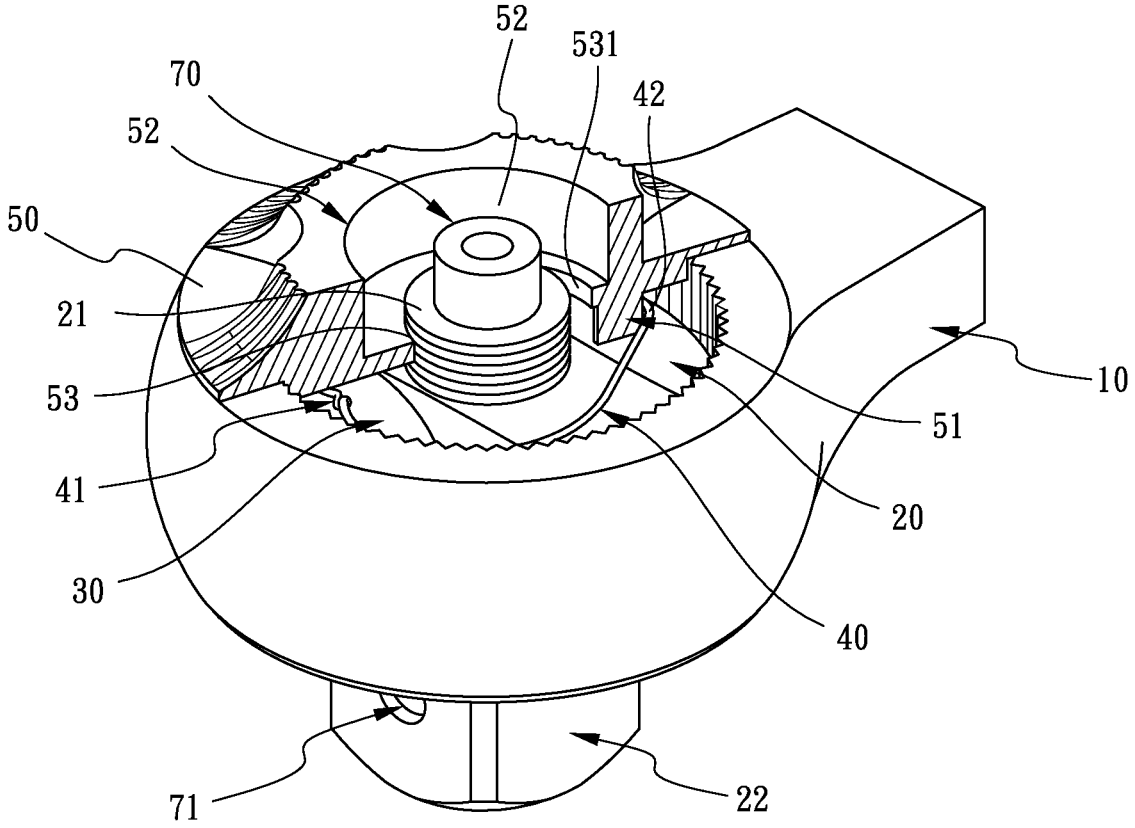
FIG. 6 is a perspective view of the ratchet wrench having easily assembling structure for showing the threaded member is passing through a second aperture of the disc.
Figure 7:
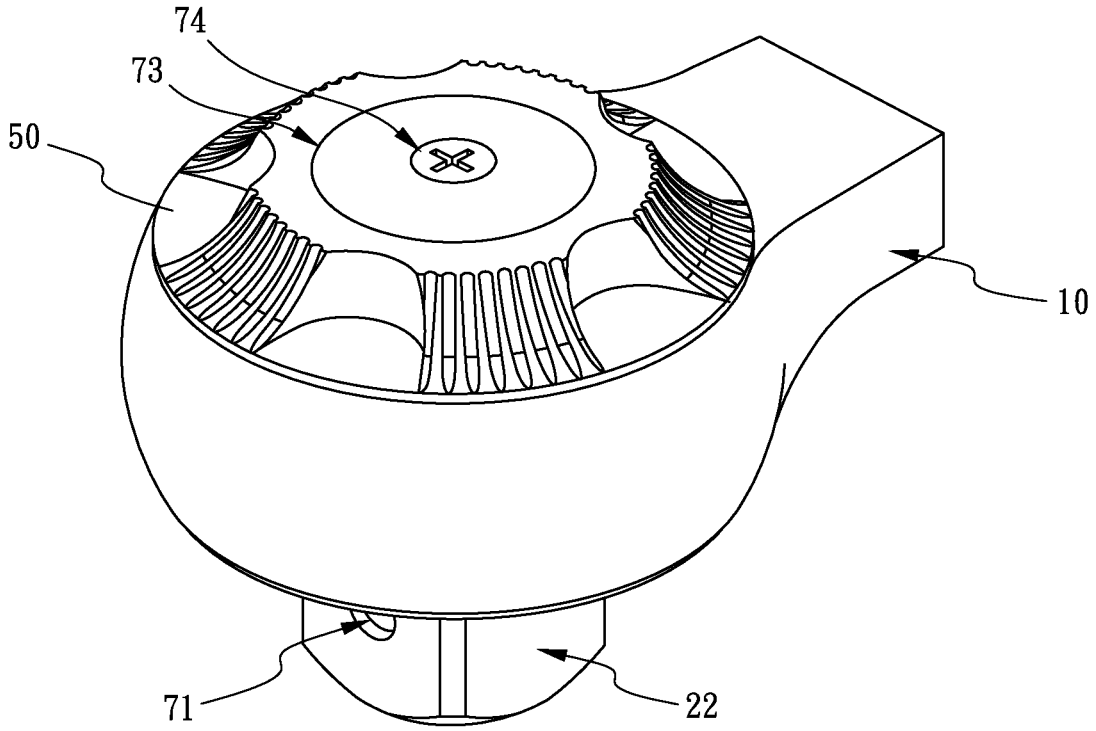
FIG. 7 is an another perspective view of the ratchet wrench having easily assembling structure.
Figure 8:
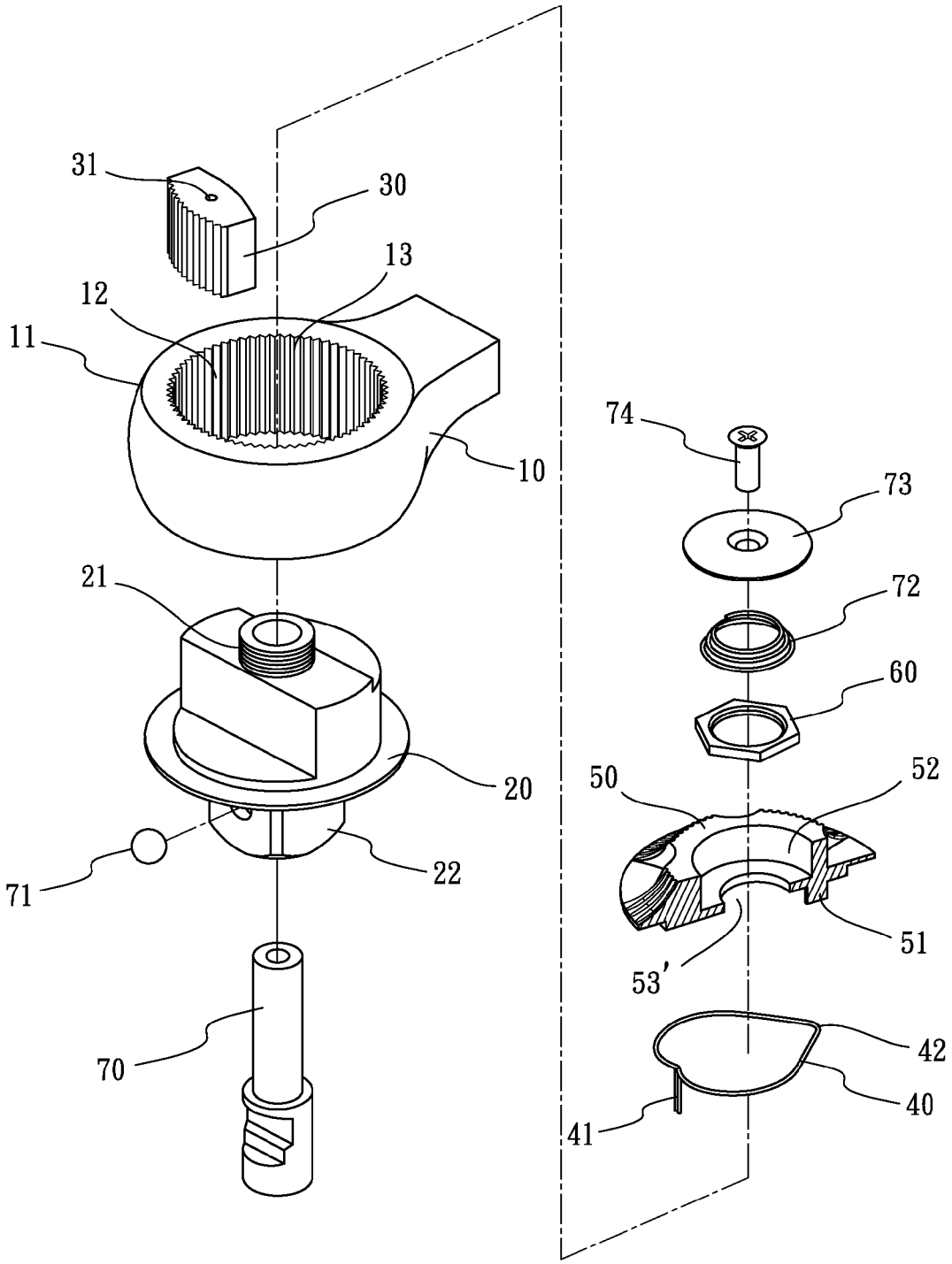
(Prior art) FIG. 8
FIG. 8 is an exploded view of a prior art in accordance to the present invention.
Figure 9:
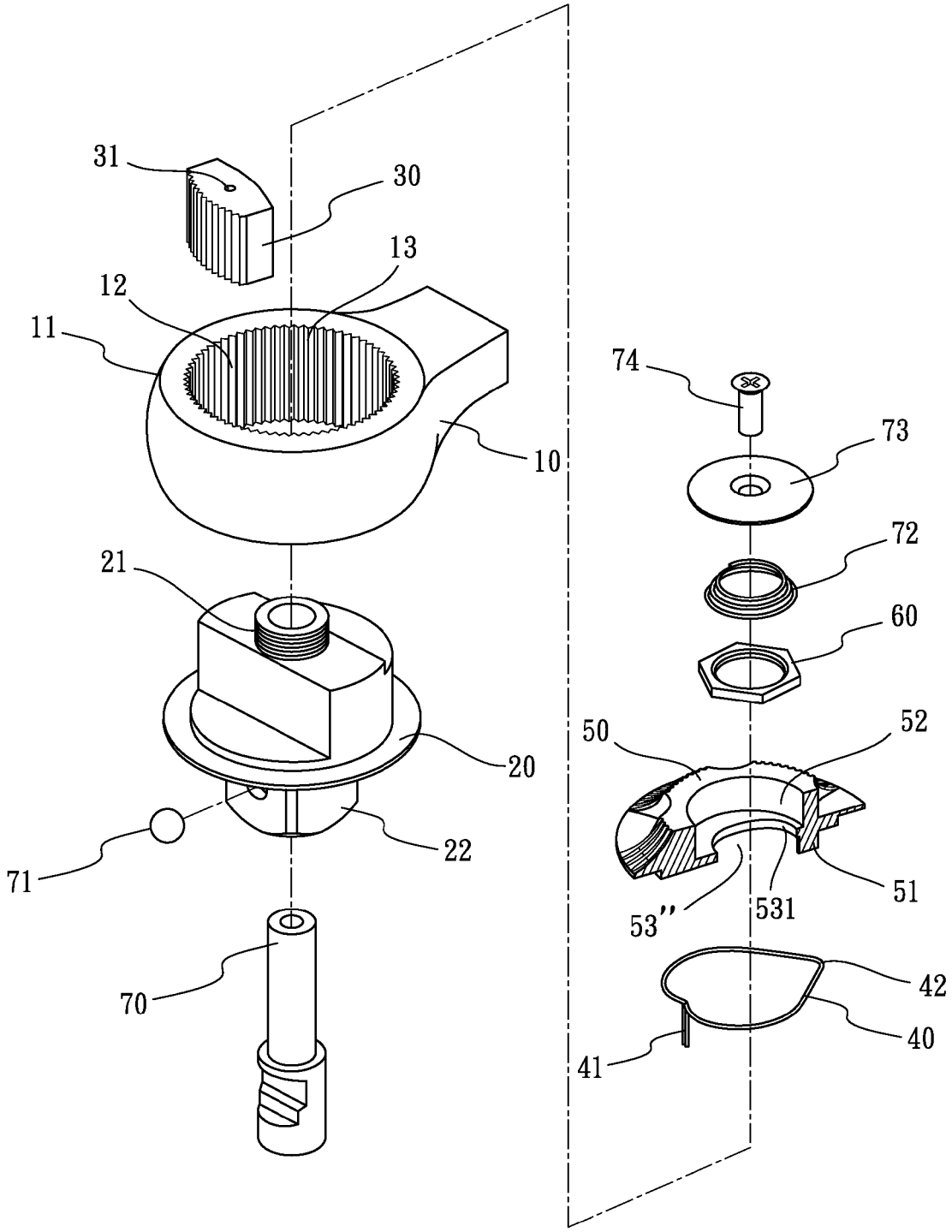
(Prior art) FIG. 9
FIG. 9 is an exploded view of another prior art in accordance to the present invention.

Secondly, the disc 50 is slightly tilted and put on the top of the head portion 11 with the top end of the threaded portion 21 protruding through the second aperture 531, as depicted in FIG. 3; at the same time, the shift pin 51 of the disc 50 is inserted in between the threaded portion 21 and the pin 51 to be ready to abut against an inner side of the closed tip 42 of the spring 40; and then, the disc 50 is laterally moved to abut against the tip 42 of the spring 40, as depicted in FIG. 3-1; and finally the disc 50 is fitly slipped into the through hole 12, as depicted in FIG. 6, so that the threaded member 21 is moved from the second aperture 531 to the first aperture 53 with the threaded member 21 protruding through the first aperture 53.

Referring to FIGS. 4-5, when the disc 50 is rotated clockwise relative to the head portion 11, the loose ratchet 30 moves to the first position of the lateral side of the D-head 20 with the shift pin 51 moving to the first place correspondingly because the loose ratchet 30 and the disc 50 are connected via the spring 40; conversely, when the disc 50 is rotated counterclockwise relative to the head portion 11, the loose ratchet 30 moves to the second position of the lateral side of the D-head 20 with the shift pin 51 moving to the second place correspondingly.

When the loose ratchet 30 is located at the first position of the lateral side of the D-head 20 and a user rotates the body 10 clockwise to operate, the D-head 20 rotates with the rotation of the head portion 11 because the loose ratchet 30 is engaged with the teeth 13 of the head portion 11. In contrast, when the user rotates the body 10 counterclockwise to operate, the D-head 20 does not rotate with the rotation of the head portion 11 because the loose ratchet 30 is moved toward the second position of the lateral side of the D-head 20 by the pushing from the teeth 13 of the head portion 11 and is disengaged with the teeth 13 of the head portion 11 step by step by the compression of the spring 40.

When the loose ratchet 30 is located at the second position of the lateral side of the D-head 20 and a user rotates the body 10 counterclockwise to operate, the D-head 20 rotates with the rotation of the head portion 11 because the loose ratchet 30 is engaged with the teeth 13 of the head portion 11. In contrast, when the user rotates the body 10 clockwise to operate, the D-head 20 does not rotate with the rotation of the head portion 11 because the loose ratchet 30 is moved toward the first position of the lateral side of the D-head 20 by the pushing from the teeth 13 of the head portion 11 and is disengaged with the teeth 13 of the head portion 11 step by step by the compression of the spring 40.

Referring to FIGS. 1-6, a push rod 70 is passing though the D-head 20 and is positioned by a screw 74 and a button 73. The button 73 is disposed onto the shouldered hole 52 and the screw 74 is screwed into the push rod 70. The screw 74, the push rod 70 and the button 73 are used to control a lateral movement of the ball 71 relative to the D-head 20. When the push rod 70 is exposed from the connecting member 22 of the D-head 20, the ball 71 is totally received in the push rod 70 so that the ball 71 is disengaged with a tool bit (not shown) to release the tool bit from the connecting member 22; conversely, when the push rod 70 is not exposed from the connecting member 22 of the D-head 20, the ball 71 is partially protruded from the push rod 70 so that the ball 71 is engaged with the tool bit to assemble the tool bit to the connecting member 22. Moreover, a compression spring 72 is assembled between the button 73 and the ring 60, and the compression spring 72 encloses a top end of the push rod 70. Under this arrangement, when the button 73 is pressed, the button 73 pushes the push rod 70 so that the push rod 70 is exposed from the connecting member 22 and the ball 71 is totally received in the push rod 70 so as to release the tool bit from the connecting member 22; in contrast, when the button 73 is released, the push rod 70 is moved back because of the restoring force of the compression spring 72 and the ball 71 is partially protruded from the push rod 70 so as to assembled the tool bit to the connecting member 22.

Although the invention has been explained in relation to its preferred embodiment, it is to be understood that many other possible modifications and variations can be made without departing from the spirit and scope of the invention as hereinafter claimed.

What is claimed is:

1. A ratchet wrench comprising a body, a D-head, a loose ratchet, a substantially heart-shaped spring, a disc and a ring;

the body having a head portion at one end thereof the head portion having a through hole opened thereon, a plurality of teeth uniformly defined on an inner wall of the through hole;

the D-head rotatably disposed in the through hole, the D-head having a connecting member formed at one end thereof, a ball assembled on a lateral side of the connecting member, the ball partially exposed from the connecting member; a threaded member assembled to another end of the D-head;

the loose ratchet disposed on a lateral side of the D-head, the loose ratchet having a pinhole opened at a top end thereof;

the substantially heart-shaped spring having at least one extension leg defined at one end thereof, the extension leg inserted into the pinhole of the loose ratchet, the substantially heart-shaped spring having a closed tip defined at another end thereof;

the disc disposed on a top of the head portion, a shouldered hole opened at a center of the disc, the shouldered hole having a first, concentric aperture and a second, eccentric aperture opened at the bottom thereof, a shift pin defined at the bottom of the disc and abutting against an inner side of the closed tip of the substantially heart-shaped spring, the first aperture and the second aperture communicating with each other to form a long groove, a ring disposed onto the shouldered hole for connecting to the threaded member; and the ring disposed onto the shouldered hole of the disc for connecting to the threaded member;

wherein, when a user rotates the body in one direction, the D-head rotates with the rotation of the head portion because the loose ratchet is engaged with the teeth of the head portion; in contrast, when the user rotates the body in another direction, the D-head does not rotate with the rotation of the head portion because the loose ratchet is disengaged with the teeth of the head portion step by step by the compression of the substantially heart-shaped spring.

2. The ratchet wrench as claimed in claim 1, further comprising a push rod, a screw and a button; the push rod passing though the D-head and being positioned by the screw and the button; wherein the button is disposed onto the shouldered hole and the screw is screwed into the push rod; and the screw, the push rod and the button are used to control a lateral movement of the ball relative to the D-head.

3. The ratchet wrench as claimed in claim 1, further comprising a compression spring assembled between the button and the ring, and wherein the compression spring encloses a top end of the push rod.

* * * * *